US011344464B2

(12) United States Patent
Davis et al.

(10) Patent No.: US 11,344,464 B2
(45) Date of Patent: May 31, 2022

(54) FUNERARY DISPLAY ARRANGEMENT WITH REMOVABLE CLOTH ASSEMBLY

(71) Applicant: Vandor Corporation, Richmond, IN (US)

(72) Inventors: Justin F. Davis, Richmond, IN (US); Gerald H. Davis, Fountain City, IN (US)

(73) Assignee: Vandor Group, Inc., Richmond, IN (US)

( * ) Notice: Subject to any disclaimer, the term of this patent is extended or adjusted under 35 U.S.C. 154(b) by 147 days.

(21) Appl. No.: 16/665,728

(22) Filed: Oct. 28, 2019

(65) Prior Publication Data

US 2021/0121352 A1 Apr. 29, 2021

(51) Int. Cl.

| | |
|---|---|
| ***A61G 17/04*** | (2006.01) |
| ***A61G 17/00*** | (2006.01) |
| ***A61G 17/007*** | (2006.01) |

(52) U.S. Cl.

CPC ..... *A61G 17/042* (2016.11); *A61G 17/004* (2016.11); *A61G 17/0073* (2013.01)

(58) Field of Classification Search

CPC ..... A61G 17/042; A61G 17/004; A61G 17/0073; A61G 17/007; A47G 9/02; A47G 9/0207; A47G 9/0238

USPC ..... 27/19

See application file for complete search history.

(56) References Cited

U.S. PATENT DOCUMENTS

| | | | | |
|---|---|---|---|---|
| 1,952,439 | A | 3/1934 | Jones | |
| RE25,545 | E | 3/1964 | White | |
| 3,233,302 | A | 2/1966 | Ross | |
| 3,395,431 | A | 8/1968 | Carson | |
| 4,003,109 | A | 1/1977 | Matichak | |
| 4,137,613 | A | 2/1979 | Ceresko | |
| 5,611,126 | A | 3/1997 | Relly | |
| 5,784,768 | A | 7/1998 | Rojdev | |
| 6,502,287 | B2 | 1/2003 | Michaud et al. | |
| 8,276,248 | B2 | 10/2012 | Cox | |
| 8,443,497 | B2 | 5/2013 | Hobstetter | |
| 8,997,319 | B2 | 4/2015 | Jenson | |
| 10,500,117 | B2 * | 12/2019 | Davis | A61G 17/0073 |
| 11,039,972 | B2 * | 6/2021 | Davis | A61G 17/001 |
| 11,141,338 | B2 * | 10/2021 | Davis | A61G 17/034 |
| 11,154,448 | B2 * | 10/2021 | Davis | A61G 17/004 |
| 2014/0026378 | A1 * | 1/2014 | Gessel | B65D 5/64 27/4 |

(Continued)

*Primary Examiner* — William L Miller

(74) *Attorney, Agent, or Firm* — Maginot, Moore & Beck LLP

(57) ABSTRACT

A cloth assembly for a casket includes a first fabric segment, a second fabric segment, and a substrate. The first fabric segment has a first length and a first width, and the second fabric segment having a second length and a second width. The substrate has a third length and a third width. The first lengthwise edge of the first fabric segment is secured to the substrate along the third length of the substrate, such that the second lengthwise edge of the first fabric segment can be disposed beyond at least one lengthwise edge of the substrate. The first lengthwise edge of the second fabric segment is secured to the substrate along the third length of the substrate, such that the second lengthwise edge of the second fabric segment can be disposed beyond the at least one lengthwise edge of the substrate.

18 Claims, 10 Drawing Sheets

(56) References Cited

U.S. PATENT DOCUMENTS

| | | | | |
|---|---|---|---|---|
| 2014/0123450 | A1* | 5/2014 | Jenson | A61G 17/004 27/14 |
| 2017/0281448 | A1* | 10/2017 | Davis | A61G 17/047 |
| 2020/0146919 | A1* | 5/2020 | Davis | A61G 17/004 |

* cited by examiner

FUNERARY DISPLAY ARRANGEMENT WITH REMOVABLE CLOTH ASSEMBLY

BACKGROUND

Caskets can be a costly element of a funeral. Inexpensive caskets necessarily are less ornate than expensive ceremonial caskets. In some cases, even caskets made of paper products can be used, particularly if the deceased is cremated rather than buried. To provide a better aesthetic presentation for lower budgets, rental casket systems have been employed. Rental casket systems can include a casket, which is rented, and a casket insert, on which the deceased is lain, which is removably inserted into the casket for presentation of the deceased.

The casket insert is an integral part of the rental casket system. Because it is illegal and otherwise undesirable to reuse a rental casket that touches human remains, the casket insert operates as a disposable conveyance for the deceased. The deceased lays on the casket insert within the rental casket, and then the deceased and rental casket can be removed and cremated together. It is also possible that the deceased (with or without the insert) could be transferred to a burial casket or vault. To allow the casket insert to be easily inserted into and removed from the casket, some known rental casket systems include a removable or hinged end panel (or side panel) that can be moved to allow the casket insert to be slid into the rental casket.

Many casket inserts are made of corrugated paper or other paper products, which are cost effective and light. However, it is undesirable for the edges and sides of the corrugated paper insert to be visible when the deceased is displayed in the rental casket. It is known, therefore, to use "throws", or decorative fabric segments, to cover the top edge of a casket container and the top edge of the casket insert. Throws have been used in traditional burial caskets and thus do not look out of place in a rental casket. Throws ideally are evenly placed along at least the visible portions of the top edges of the casket container. The design and placement of throws can require care, and particularly if inexpensive materials are used, it can be difficult to effectuate an aesthetically pleasing throw placement.

It is also useful in caskets to have interior fabric elements, referred to herein as "skirts", to cover the visible portions of the interior sides and bottom of the casket insert. An aesthetically pleasing placement of skirts, particularly in conjunction with the placement of throws, can be difficult to accomplish.

There is a need, therefore, for more convenient way to achieve an orderly and pleasing placement of a casket throw and/or skirt in a funerary display arrangement.

SUMMARY

At least some embodiments described herein address the above-stated need by providing a skirt and throw placement system for use in a reusable funerary container.

A cloth assembly for a casket includes a first fabric segment, a second fabric segment, and a substrate. The first fabric segment has a first length and a first width, and the second fabric segment having a second length and a second width. The substrate has a third length and a third width. The first lengthwise edge of the first fabric segment is secured to the substrate along the third length of the substrate, such that the second lengthwise edge of the first fabric segment can be disposed beyond at least one lengthwise edge of the substrate. The first lengthwise edge of the second fabric segment is secured to the substrate along the third length of the substrate, such that the second lengthwise edge of the second fabric segment can be disposed beyond the at least one lengthwise edge of the substrate.

A second embodiment is a funerary display arrangement that includes a container and a cloth assembly. The container is sized and configured to receive a human body in the supine position. The container includes at least a first side panel and a first end panel affixed to a bottom panel. The first side panel has a side panel interior surface, a side panel exterior surface, and a side panel top edge surface. The first end panel has an end panel interior surface, an end panel exterior surface, and an end panel top edge surface. The side panel interior surface includes at least a first receptacle affixed thereto, the first receptacle including a first surface affixed to the side panel interior surface, and at least a second portion extending inward from the side panel interior surface and upward, the first receptacle configured to receive and position at least a part of a substrate having at least a fabric segment attached thereto. The end panel interior surface includes at least a second receptacle affixed thereto, the second receptacle including a first surface affixed to the side panel interior surface, and at least a second portion extending inward from the side panel interior surface and upward, the second receptacle configured to receive and position at least a portion of a substrate having at least a fabric segment attached thereto.

The above-described features and advantages, as well as others, will become more readily apparent to those of ordinary skill in the art by reference to the following detailed description and accompanying drawings.

DETAILED DESCRIPTION

Figure 1:
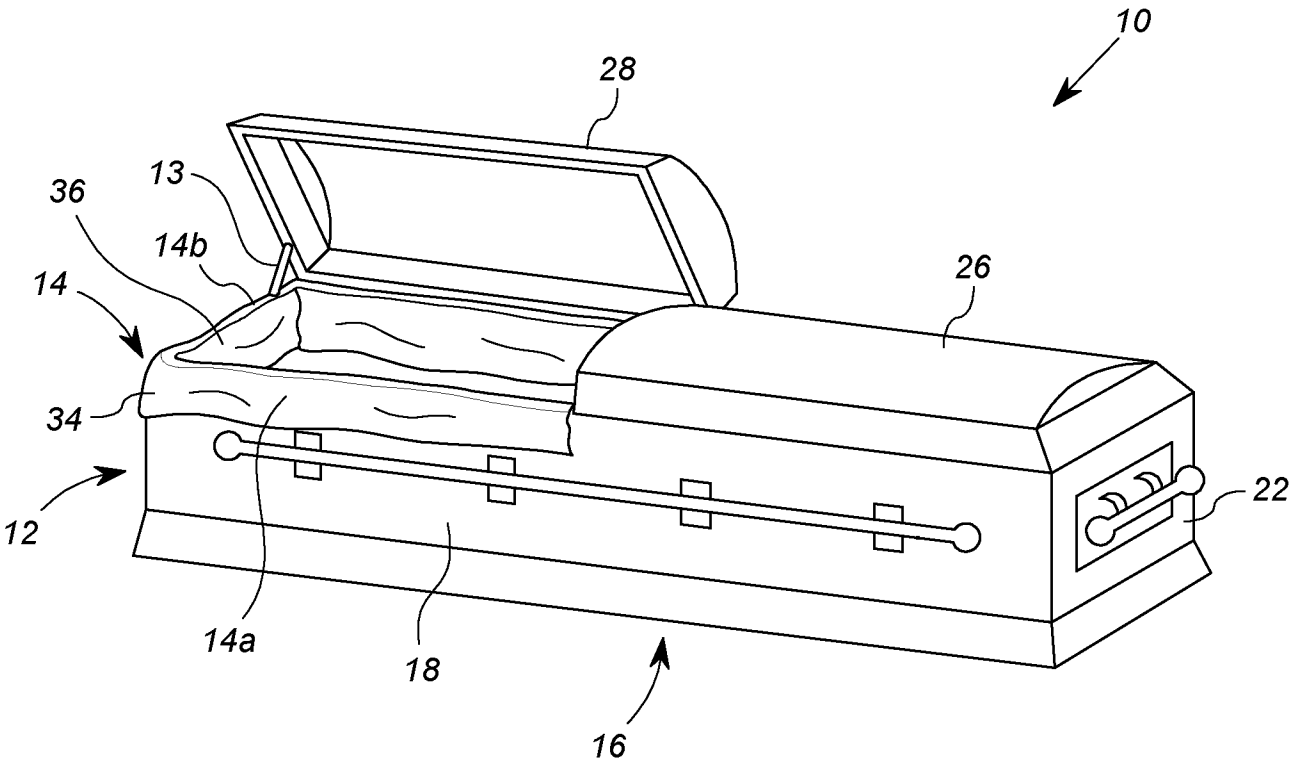
FIG. 1 shows a perspective view of a first embodiment of a funerary display arrangement according to the invention.

For the purposes of promoting an understanding of the principles of the invention, reference will now be made to the embodiments illustrated in the drawings and described in the following written specification. It is understood that no limitation to the scope of the invention is thereby intended. It is further understood that the present invention includes any alterations and modifications to the illustrated embodiments and includes further applications of the principles of the invention as would normally occur to one of ordinary skill in the art to which this invention pertains.

Figure 2A:
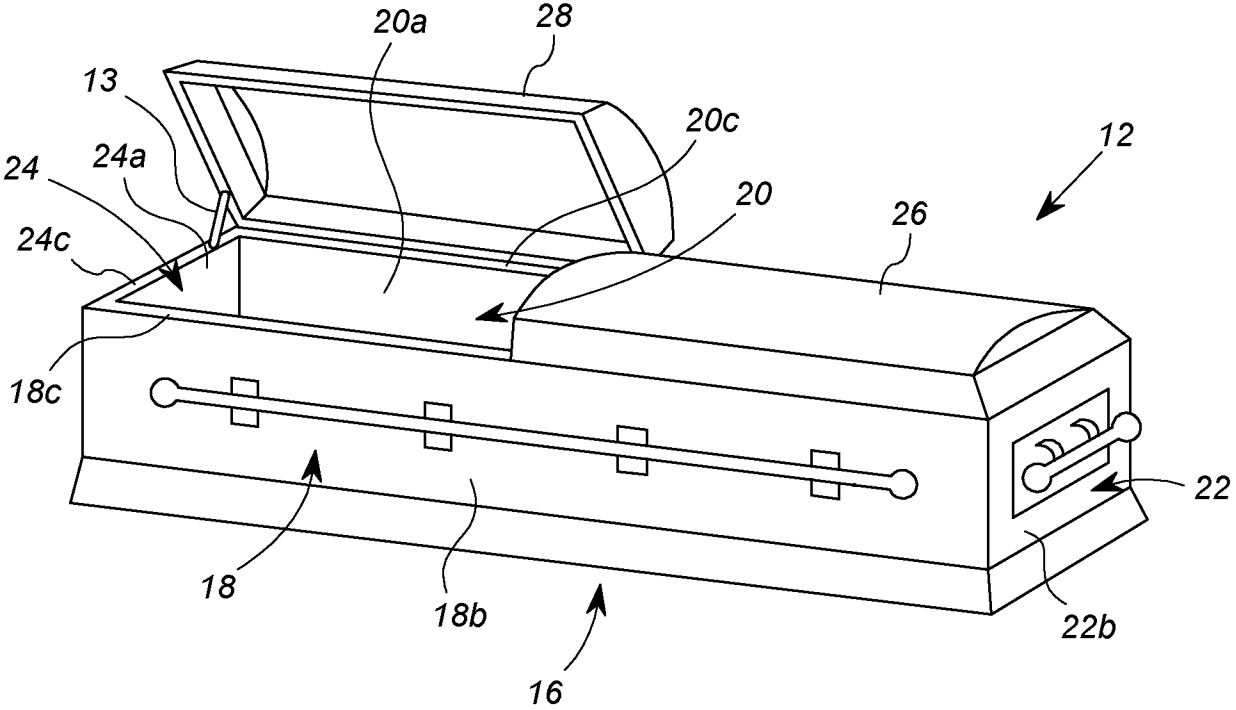
FIG. 2A shows a perspective view of the container of the funerary display arrangement of FIG. 1 apart from the cloth assembly.
Figure 3A:
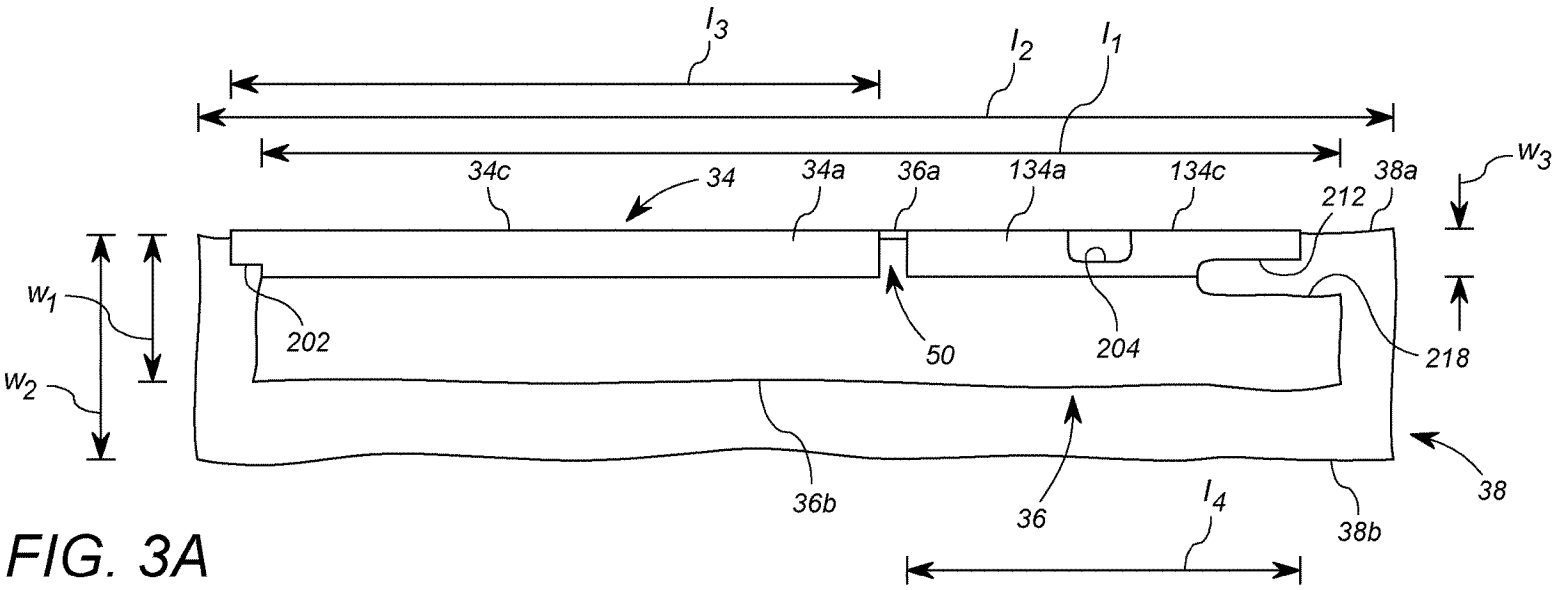
FIG. 3A shows a plan view of a first side of the cloth assembly of the funerary display arrangement of FIG. 1 prior to installation into the casket.
Figure 3B:
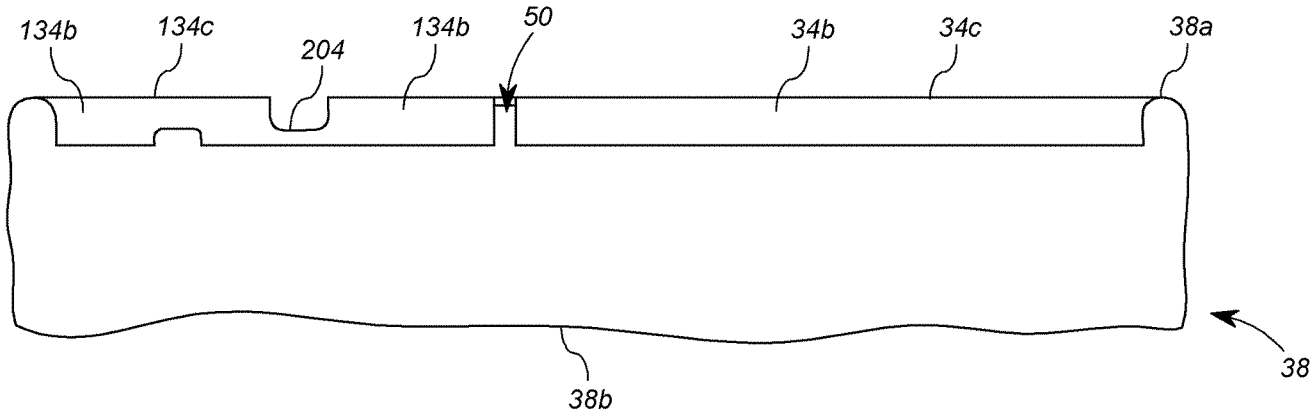
FIG. 3B shows a plan view of a second side of the cloth assembly of the funerary display arrangement of FIG. 1 prior to installation into the casket.

FIGS. 1, 2A, 3A, and 3B collectively show an exemplary funerary display arrangement 10 that includes, in this embodiment a container 12 and a cloth assembly 14. FIG. 1 shows a perspective view of the funerary display arrangement 10 fully assembled for a viewing of the deceased. FIG. 2A shows a perspective view of the container 12 apart from the cloth assembly 14. FIGS. 3A, 3B show perspective views of opposite sides of the cloth assembly 14, in a partially unfolded condition prior to installation onto the container 12.

The container 12 is sized and configured to receive and reasonably fit a human body in the supine position, or in other words, in traditional positioning within a casket. The container 12 includes a bottom panel 16 (see also FIG. 6) defining a length and width of the container 12 sufficient to receive the supine human body (or a casket insert 8 on which a human body, not shown, is placed). Affixed to the bottom panel 16 are first and second side panels 18, 20 and first and second end panels 22, 24, which collectively with the bottom panel 16 form an open top box. The term "panel" as used herein shall mean a wall structure, formed of any suitable solid material or combination of materials, whether or not formed of multiple layers and/or materials, and which may include aesthetic features or reliefs.

Each of the side panels 18, 20, and end panels 22, 24 includes an interior surface facing the interior 30 of the container 12, an opposite facing exterior surface, and a top edge surface. With reference to FIGS. 2A, 5, 6 and 8, for example, the side panel 18 includes an interior surface 18*a*, an exterior surface 18*b*, and a top edge 18*c*, and the end panel 24 includes an interior surface 24*a*, an exterior surface 24*b*, and a top edge 24*c*. Although not fully visible, the exterior surface 24*b* of the end panel 24 may suitably be identical to the exterior surface 22*b* of the end panel 22 shown in FIGS. 1 and 2A.

In this embodiment, the container 12 is in the form of a casket that also has a height sufficient to contain the human body. However, it will be appreciated that in other embodiments, the height of the container 12 (and hence the height of the panels 18, 20, 22, and 24) may be reduced for use in alternative viewing events that do not involve a full casket.

Figure 2B:
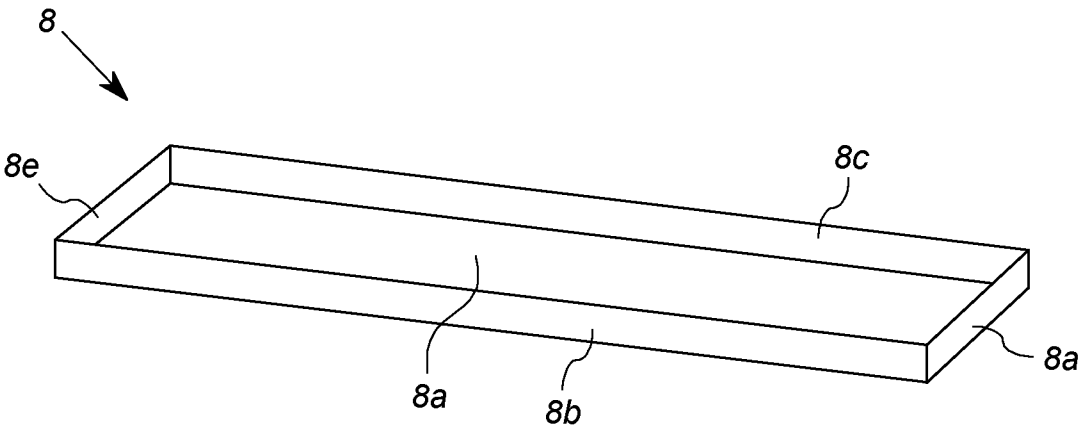
FIG. 2B shows an optional casket insert that may be used in the funerary display arrangement of FIG. 1.

In at least some embodiments, the container 12 is intended for use as a rental casket, which requires a casket insert for transporting and supporting the body within the container 12. While the rental casket may be reused, the casket insert is used for a single use. FIG. 2B shows an exemplary casket insert 8 which may be used as an insert that supports a human deceased in the container 12. The casket insert 8 may suitably be made of corrugated paper, and includes a bottom panel 8*a*, side panels 8*b*, 8*c*, and end panels 8*d*, 8*e*. The casket insert 8 is sized such that the side panels 8*b*, 8*c* and end panels 8*d*, 8*e* surround the deceased, and such that it fits in the interior 30 of the container 12. The casket insert 8 may take any suitable form, including but not limited to that disclosed in U.S. Pat. No. 8,104,151. To facilitate insertion of the casket insert 8, the end panel 22 (or any other panel 18, 20, and 24) may be removable, or otherwise openable to allow the casket insert 8 to be slid into the casket. Suitable designs of an end panel designed for receiving casket inserts are disclosed in U.S. Pat. Nos. 8,607,423 and 9,597,248, both of which are incorporated herein in their entirety by reference.

The container 12 in the casket embodiment also includes a cap 26 and a lid 28. The cap 26 covers a foot end portion container 12, and sits on the top edges 18*c*, 20*c* of the side panels 28 20, and on the top edge of the end panel 22, not visible in FIGS. 1 and 2A. The cap 26 may take any suitable aesthetic form, and may or may not be capable of being opened or removed. The lid 28 is sized and configured to cover the head end of the container 12, but is in an open position during the funerary display event, so that head and upper torso of the deceased is visible. To this end, the lid 28 may have a similar structural and external design as that of the cap 26, so that if the lid 28 were closed, the cap 26 and the lid 28 would form a consistent lid design, preferably symmetrical. The lid 28 is operably coupled to the side panel 20. In a traditional casket, the lid 28 is coupled to the side panel 20 via hinges that may be closed. However, in a rental casket embodiment, the lid 28 need not necessarily be closable.

Figure 7:
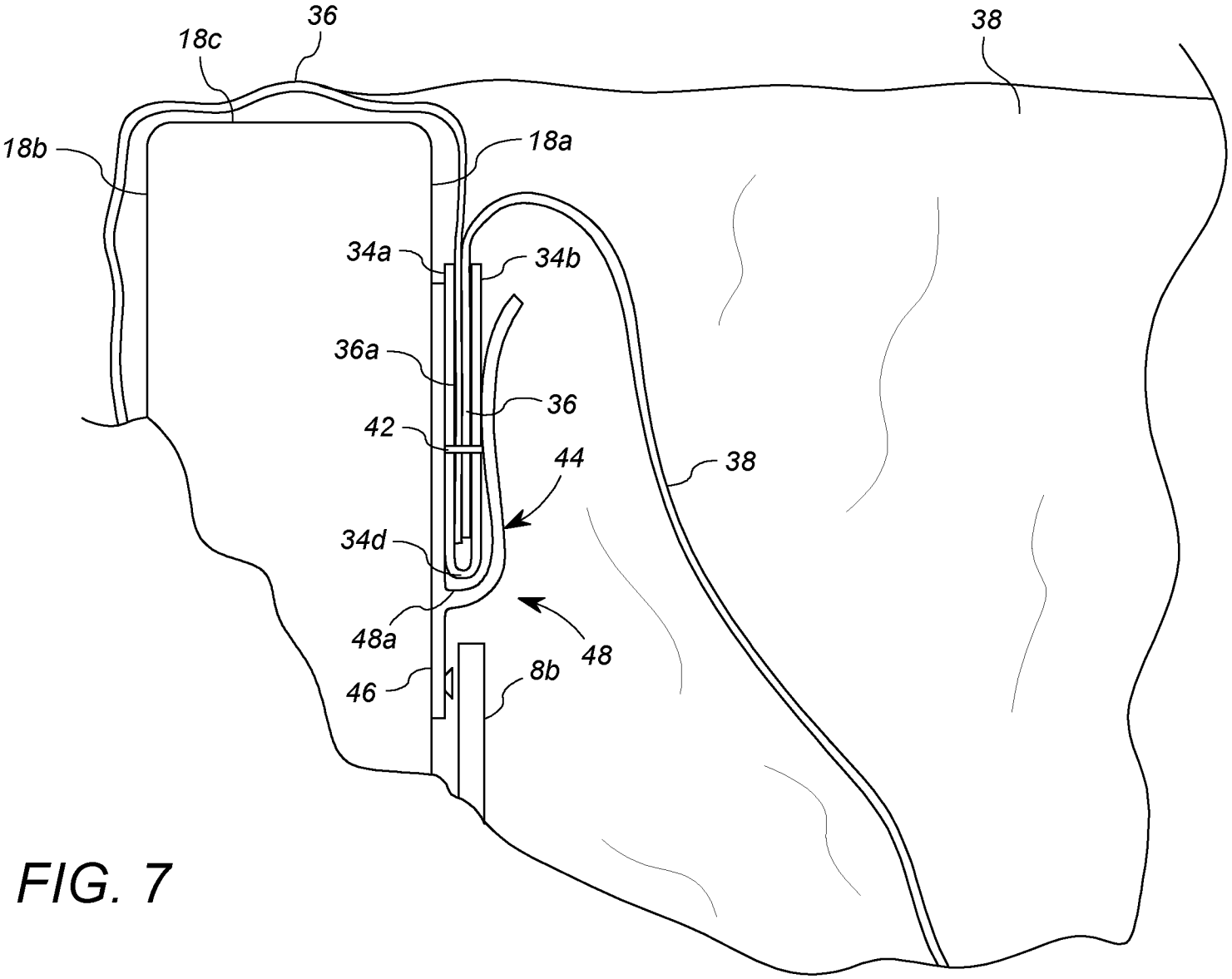
FIG. 7 shows a cutaway fragmentary view of cloth assembly of FIGS. 3A and 3B inserted within the container of FIG. 2A.

As shown in FIG. 1, the cloth assembly 14 includes a first portion 14*a* disposed along a portion of the side panel 20 that extends from the end panel 24 to the nearest end of the cap 26, and a second portion disposed along substantially the entire end panel 24. In this embodiment, the cloth assembly 14 is folded into the first portion 14*a* and the second portion 14*b*. In particular, FIGS. 3A and 3B show the cloth assembly 14 apart from the container 12 and in unfolded condition. FIG. 3A shows a perspective view of a first side of the cloth assembly 14, and FIG. 3B shows a perspective view of the opposite side of the cloth assembly 14. FIG. 7 shows a cross section of the cloth assembly 14 as assembled onto the container 12.

With reference to FIGS. 3A, 3B and 7, the cloth assembly 14 comprises a first substrate 34, a second substrate 134, a first fabric segment 36, and a second fabric segment 38. Each of the fabric segments 36, 38 includes one or more layers of sheeted, flexible material, such as woven cloth, non-woven cloth-like material, crepe, and the like. The first fabric segment 36 has having a first length $l_1$ and a first width $w_1$, and the second fabric segment 38 has having a first length $l_2$ and a first width $w_2$. The lengths $l_1$ and $l_2$ may suitable be similar, but need not be identical. Preferably, $l_2$ is somewhat greater than $l_1$ in this embodiment because the second fabric segment 38 forms the skirt, and the first fabric segment 36 forms the throw. For the same reason, the width $w_2$ may suitably be greater than the width $w_1$, but other proportions may be used. Each of the fabric segments 36, 38 has a first lengthwise edge 36*a*, 38*a*, and a second lengthwise edge 36*b*, 38*b*. Although, the first lengthwise edge 36*a* of the first fabric segment 36 is largely hidden in FIG. 3A, and is not visible in FIG. 3B, it is shown in FIG. 4B, discussed further below.

As mentioned above, the first fabric segment 36 forms the throw of the casket, and in this embodiment includes at least a crepe layer, a padding layer, and fabric (woven or non-wove) layer, suitably stitched together using known methods. The second fabric segment 38 forms a skirt, and thus does not require as many layers. In this embodiment, the second fabric segment includes one or two layers of flexible sheet, such as crepe layer with padding or a non-woven backing, stitched together using known methods.

The first substrate 34 in this embodiment has a length $l_3$, and the second substrate 134 has a length $l_4$, and both have the same width $w_3$. The combined lengths $l_3$ and $l_4$ are roughly equivalent to (but typically slightly less than) $l_2$. As shown in FIGS. 3A, 3B and 7, the first substrate 34 comprises a lengthwise folded cardboard substrate having a first portion 34*a* lengthwise folded along a fold edge 34*c* over a second portion 34*b*. Similarly, the second substrate 134 comprises a lengthwise folded cardboard substrate having a first portion 134*a* lengthwise folded along a fold edge 134*c* over a second portion 134*b*. The first substrate 34 is in the first portion 14*a* of the cloth assembly 14, and second substrate is in the second portion 14*b* of the cloth assembly 14.

Figure 4A:
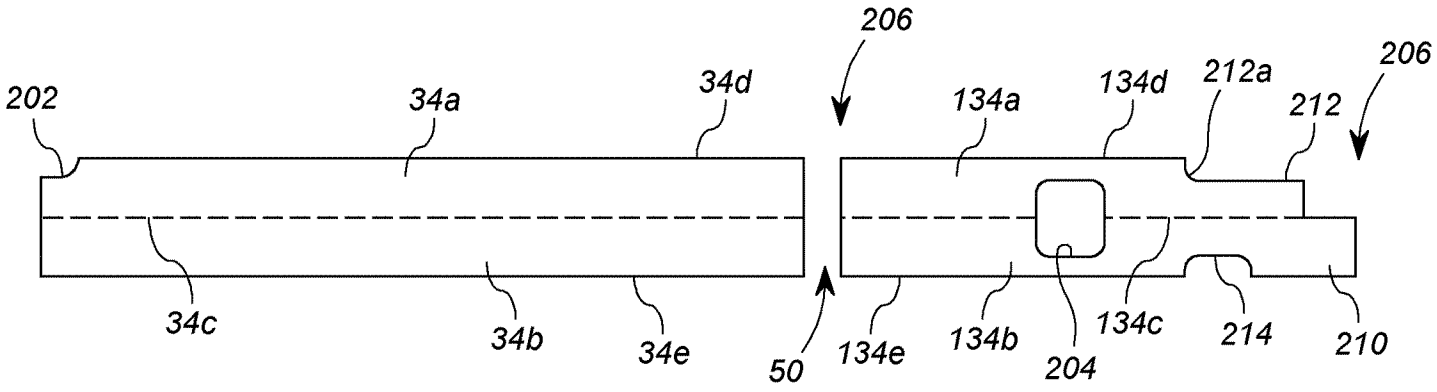
FIG. 4A shows a plan views of substrates used in the close assembly of FIGS. 3A and 3B.
Figure 4B:
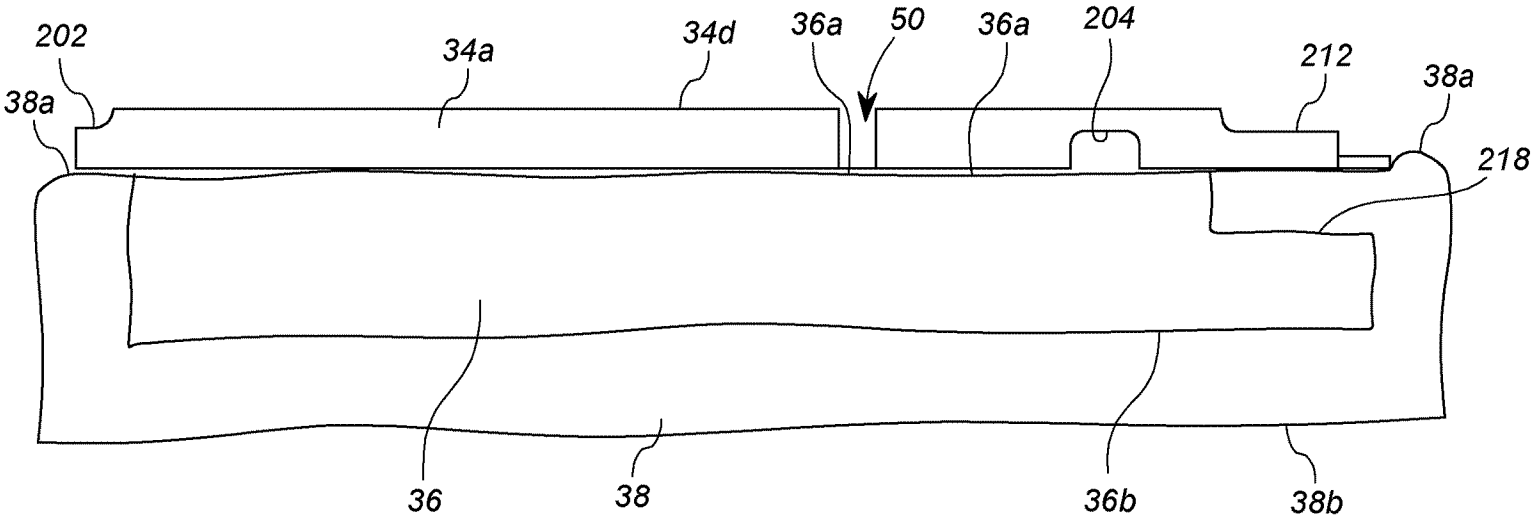
FIG. 4B shows the cloth assembly of FIGS. 3A and 3B in a partially assembled state.

FIG. 4A shows a top plan view of a flat blank of the first and second substrates 34, 134. The first portion 34*a* of the first substrate 34 extends lengthwise, and has a width defined between the fold edge 34*c* and top edge 34*d*. The second portion 34*b* of the first substrate 34 extends lengthwise, and has a width defined between the fold edge 34*c* and a bottom edge 34*e*. In general, the first portion 34*a* folds over the second portion 34*b* at the fold edge 34*c* such that the edges 34*d*, 34*e* align. As a result, in this case, both the first portion 34*a* and second portion 34*b* of the first substrate 34 have the width $w_3$. In other embodiments where the widths are unequal, the larger width of the portions 34*a*, 34*b* will define $w_3$. The fold edge 34*c* defines the lengthwise edge 34*c* of the assembled substrate 34 as shown in FIGS. 3A and 3B. The first portion 34*a* also includes a small corner notch 202 in the top edge 34*d* at the end most distant from the second substrate 134 in the cloth assembly 14.

The first portion 134*a* of the second substrate 134 similarly extends lengthwise, and has a width defined between the fold edge 134*c* and a top edge 134*d*. The second portion 134*b* of the second substrate 134 extends lengthwise, and has a width defined between the fold edge 134*c* and a bottom edge 134*e*. As with the first substrate 34, the first portion 134*a* folds over the second portion 134*b* at the fold edge 134*c* such that the edges 134*d*, 134*e* align. The fold edge 134*c* defines the lengthwise edge 134*c* of the assembled substrate 134 as shown in FIGS. 3A and 3B. The second substrate 134 also include a central opening 204 intermediate the top edge 134*d* and bottom edge 134*e*, to accommodate hardware elements, not shown, which are located on the end wall interior surface 24*a* of the container 12. In this embodiment, the first portion 134*a* has a first end 206 and a second end 208. At the second end 208, the second portion 134*b* has a tab 210 that extends further than the first portion 134*a* at the second end 208. In addition, the first portion 134*a* includes a stepped cutout or notch 212 along the top edge 134*d* that terminates between the central opening 204 and the second end 208. The bottom edge 134*d* also includes a small U-shaped cutout or notch 214 that aligns with an inward end 212*a* of the step notch 212, but does not entirely co-extend with the step notch 212. The step notch 212 and U-shaped notch 214 help accommodate the hinge elements 13 of the casket container 12.

Referring again to FIGS. 3A and 3B, the first substrate 34 and second substrate 134 are spaced apart to define a gap 50. The gap 50 allows for folding between the first portion 14*a* and second portion 14*b* of the assembled cloth assembly 14, which would otherwise possibly create difficulties and/or undesirable fabric bunching. The gap 50 also allows for additional portions of the first fabric segment 36 to be available to cover the corner between the side panel 18 and end panel 24.

Referring again to FIGS. 3A, 3B, and 7, a first part of the first lengthwise edge 36*a* of the first fabric segment 36 and at least a first part of the first lengthwise edge 38*a* of the second fabric segment 38 are disposed between and secured to the first portion 34*a* and the second portion 34*b* of the substrate 34. A second part of the first lengthwise edge 36*a* of the first fabric segment 36 and at least a second part of the first lengthwise edge 38*a* of the second fabric segment 38 are disposed between and secured to the first portion 134*a* and the second portion 134 of the second substrate 134. Thus, in this embodiment, the fabric segments 36, 38 that connects the first portion 14*a* of the cloth assembly 14 to the second portion 14*b* of the cloth assembly 14. In other embodiments, the first portion 14*a* and second portion 14*b* may be totally separate.

The edges 36*a*, 38*a* may be secured between the folded over portions 34*a*, 34*b*, 34*c* portions of the substrate 34 via staples, adhesive or other fasteners. It will be appreciated that the width $w_1$ is sufficient for the first fabric segment 36 to extend well out of the installed substrate 34, such that is can cover the top edges 18*c* and 24*c* of the respective side panel 18 and end panel 24, of the container, and at least a part of the corresponding exterior surfaces 18*b*, 24*b*, as shown in FIG. 1. Likewise, the width $w_2$ is sufficient for the second fabric segment 36 to extend well out of the installed substrate 34, and can cover the wall 8*b* and at least a part of the bottom panel 8*a* of the insert 8. It will further be appreciated that the fastening agents or adhesive need not directly contact the edges 36*a*, 38*a* of the fabric segments 36, 38, but rather contact the corresponding fabric segments 36, 38 one or two inches inward.

Assembly of the cloth assembly 14 is described in conjunction with FIGS. 4A and 4B. Referring to FIG. 4A, the unfolded blanks of substrates 34, 134 are aligned such that fold edges 34*c*, 134*c* are substantially co-linear. Although not necessary for proper function of the cloth assembly, the top edges 34*d*, 134*d* also align with each other, as do the bottom edges 34*e*, 134*e*. The adjacent ends of the substrates 34, 134 are spaced apart by one or more inches to form the gap 50, discussed above. The second fabric segment 38 is then placed on the substrates 34, 134 such that its lengthwise edge 38*a* covers the second portions 34*b*, 134*b* of the substrates 34, 134, and is near the fold edges 34*c*, 134*c*. The first fabric segment 36 is then placed on the second fabric segment 38 such that its lengthwise edge 36*a* aligns with the lengthwise edge 38*a* and fold edges 34*c*, 134*c*. The resulting layout is shown in FIG. 4B. As shown in FIG. 4B, the lengthwise edge 36*a* of the first cloth assembly 36 includes a notch 218 at the corner closest to the notches 212, 214, which extends inward such that the notch 218 ends at about the same lengthwise location as the ends of the notches 212, 214.

In this embodiment, the first portion 34*a*, 134*a* of the respective first and second substrates 34, 134 are then folded at the fold edges 34*c*, 134*c* over the lengthwise edges 36*c*, 38*c* of the fabric segments 36, 38. Staples 42 are stapled through the first portion 34*a*, the fabric segments 36, 38 and the second portion 34*b*. FIG. 7 shows the result of such operation. Other staples are stapled through the first portion 134*a*, the fabric segments 36, 38 and the second portion 134*b* in the same way. The resulting structure is the cloth assembly 14 shown in FIGS. 3A and 3B.

It will be appreciated that in other embodiments the first portion 14*a* and second portion 14*b* of the cloth assembly may be separate, and thus not foldably attached. In such as case, both portions would have first and second fabric segments similar to the fabric segments 36, 38 attached in the same way. In still other embodiments, the cloth assembly 14 may be adapted to extend down the entire length of the side panel 18, and in some cases including a third portion (attached or separate) that extends around to and along the end panel 22. Such an arrangement would be useful in a so-called "full-couch" casket arrangement wherein the container 12 includes single, full length lid. A similar arrangement may be adapted for use with a non-traditional viewing tray arrangement.

Figure 5:
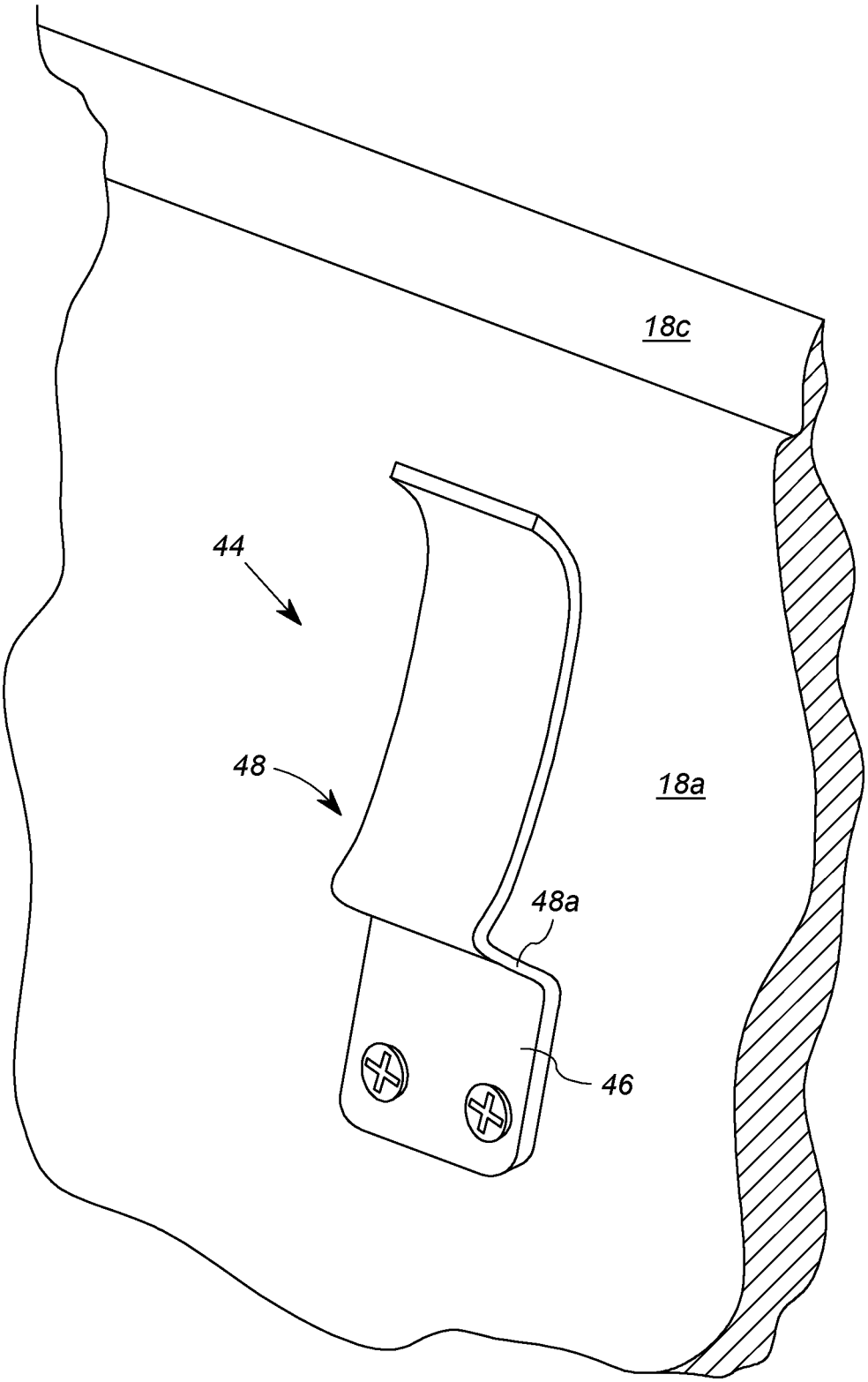
FIG. 5 shows a perspective view of a first embodiment of a receptacle that may be used in the container of FIG. 2A to assist in mounting the cloth assembly.
Figure 6:
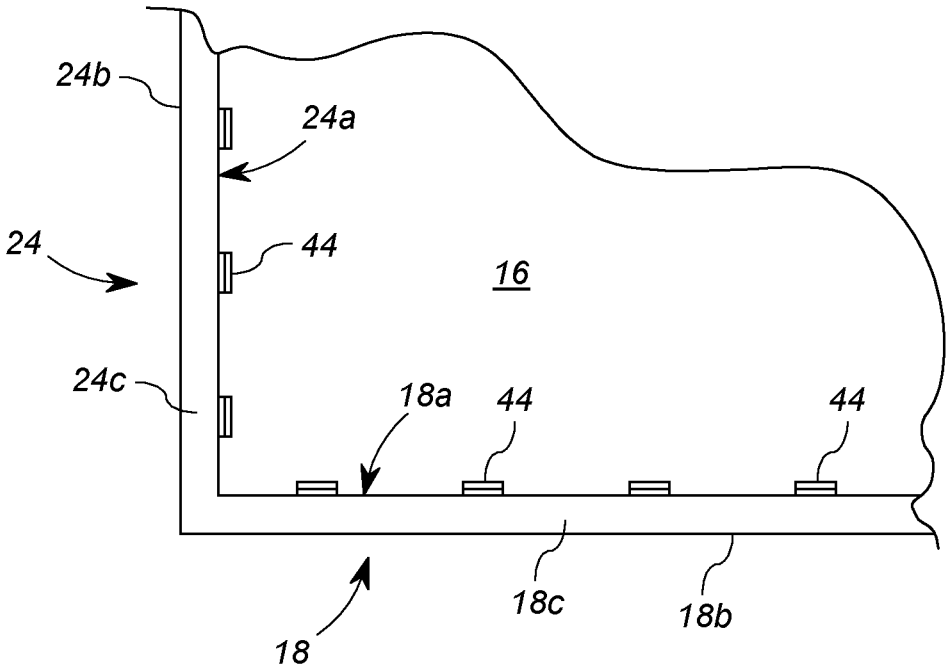
FIG. 6 shows a fragmentary plan view of the container of FIG. 2A.

The cloth assembly 14 in this embodiment is affixed in position on the container 12 as a result of interaction between one or more receptacles on in the interior surfaces of the container and the substrate 34. FIGS. 5, 6 and 7 show an exemplary arrangement of the receptacles. FIG. 5 shows a fragmentary perspective view of a receptacle 44 mounted on a side wall interior surface 18*a*, and FIG. 6 shows a fragmentary top plan view of the container 12 apart from the cloth arrangement 14 showing the placement of receptacles 44 in the container 12. FIG. 7 shows a side cutaway view of the cloth assembly 14 inserted into the receptacle 44.

As shown in FIG. 6, the side panel interior surface 18*a* and end panel interior surface 24*a* include a plurality of receptacles 44 affixed thereto. As shown in FIGS. 5 and 7, each receptacle 44 includes a first portion 46 affixed to the side panel interior surface 18*a*, and a second portion 48 extending inward from the side panel interior surface 18*a* and upward. The receptacles 44 are attached to the end panel interior surface 24*a* in the same manner. Each receptacle 44 is configured to receive and position at least a part of the substrate 34. To this end, the second portion 48 of each receptacle 44 includes support surface 48*a* upon which the substrate 34 is supported. The second portion 48 of each receptacle 44 also forms a spring biased clip that extends upward from the support surface 48*a*.

The receptacles 44 are all disposed at a predefined height (measured either from the bottom panel 16 or from the top edges 18*c*, 24*c* of the side and end panels 18, 24). The receptacles 44 thereby cooperate with the substrate 34 to facilitate easy, accurate, accurate assembly of the cloth assembly 14 onto the container 12.

In an exemplary operation, the cloth assembly 14 is typically used in conjunction with the casket insert 8 and the container 12. The casket insert 8 typically carries the deceased. To facilitate a funereal display, the casket insert 8 with the deceased is placed into the container 12. As discussed above, the end panel 22 may be removable, or open on hinges to allow the casket insert 8 with the deceased to be slid into the container 12.

Once the casket insert 8 is in place, the user inserts the fold edge 34*c* of the substrate 34 into the receptacles 44, as shown in FIG. 7. The support surface 48*a* and the remainder of the second portion 48 of the receptacle 44 secure the substrate 34 at a predetermined height in the container 12. It will be appreciated that the gap 50 may be collapsed when inserted to free up additional portions of the first fabric segment 36 to cover the corner between the end panel 24 and side panel 18. The second fabric segment 38 is then draped over the side panel interior surface 18*a*, as well as a side wall 8*b* of the casket insert 8, as shown in FIG. 7. The second fabric segment 38 also covers the inward portion 34*b* of the substrate 34 and the second portions 48 of the receptacles 44. The second fabric segment 38 in such a configuration performs the function of a casket skirt, which provides a soft fabric outline to the deceased, and obscures the casket insert 8.

The first fabric segment 36 is then draped in the other direction, over the top edges 18*c*, 24*c* of the side and end walls 18, 24, respectively. The first fabric segment 36 in such a configuration performs the function of a casket throw.

After the funerary viewing event, the casket insert 8 is removed, and then transported away from the container for cremation or burial. The cloth assembly 14 is destroyed or discarded, but in any event is not re-used. To this end, the user may simply pull the substrate 34 out of the receptacles 44 and properly dispose of the entire cloth assembly 14.

Figure 8:
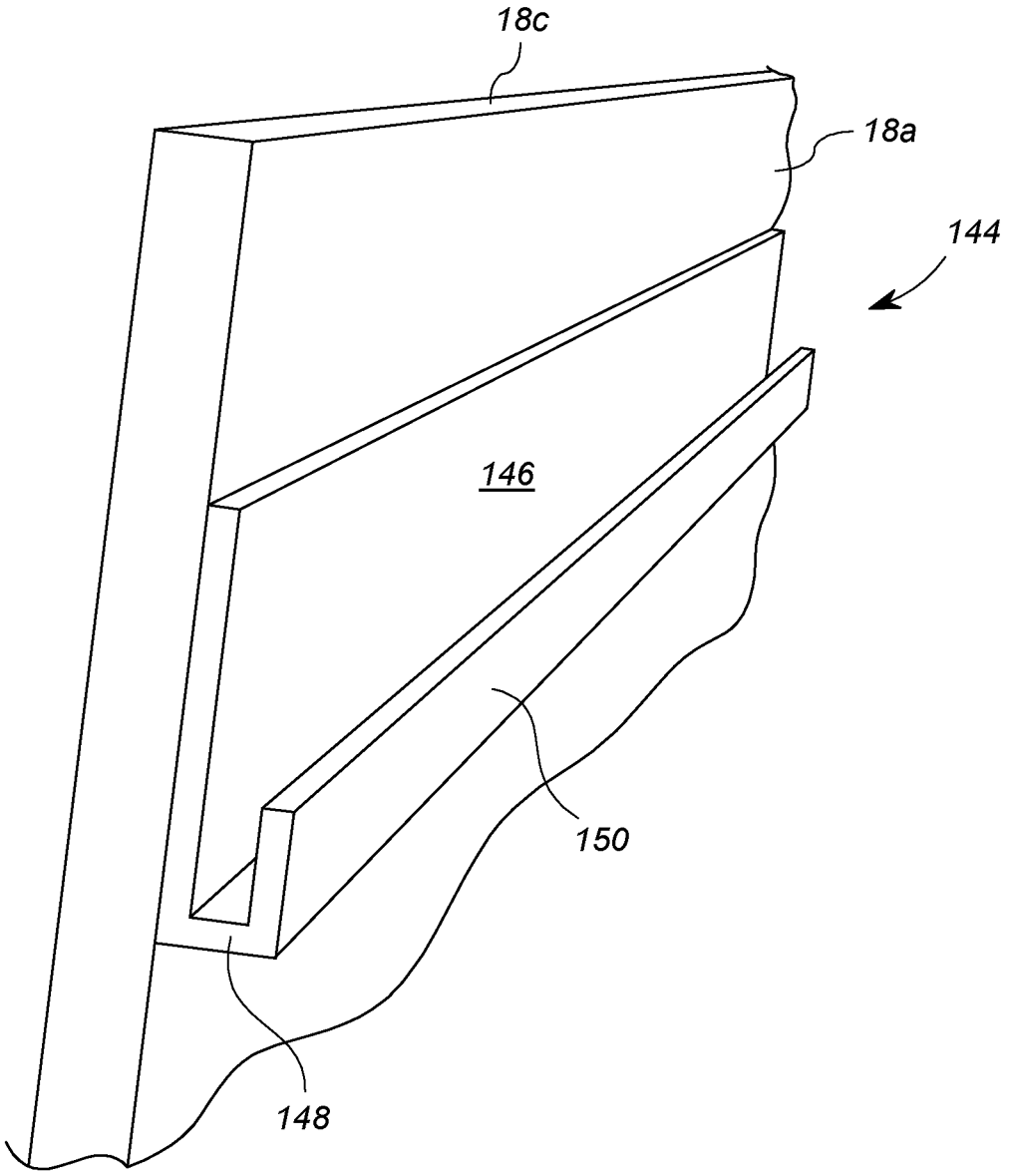
FIG. 8 shows an alternative embodiment of a receptacle that may be used in the casket of FIG. 2A to assist in mounting the cloth assembly.

FIG. 8 shows an alternative of a receptacle 144 that may be used in the container 12 of FIGS. 1 and 2. The receptacle 144 in this embodiment is an extruded piece of material, such as plastic or polymer, that forms a J-shaped channel. The receptacle 144 includes a first plate or wall 146 attached to the side panel interior surface 18*a*, which extends at least half of the distance between the end panel 24 and the location on the side panel 18 where the cap 26 begins. The receptacle 144 also includes a second portion having a bottom wall 148 that extends inward from the first wall 146 and a retaining wall 150 that extends upward from the end of the bottom wall 148. The bottom wall 148 is configured to engage the fold edge 34*c* of the substrate 34, and may suitably be substantially horizontal. The retaining wall 150 is configured to retain the substrate 34 laterally. In this embodiment, a similar J-channel receptacle is affixed to the end wall 24.

Figure 9:
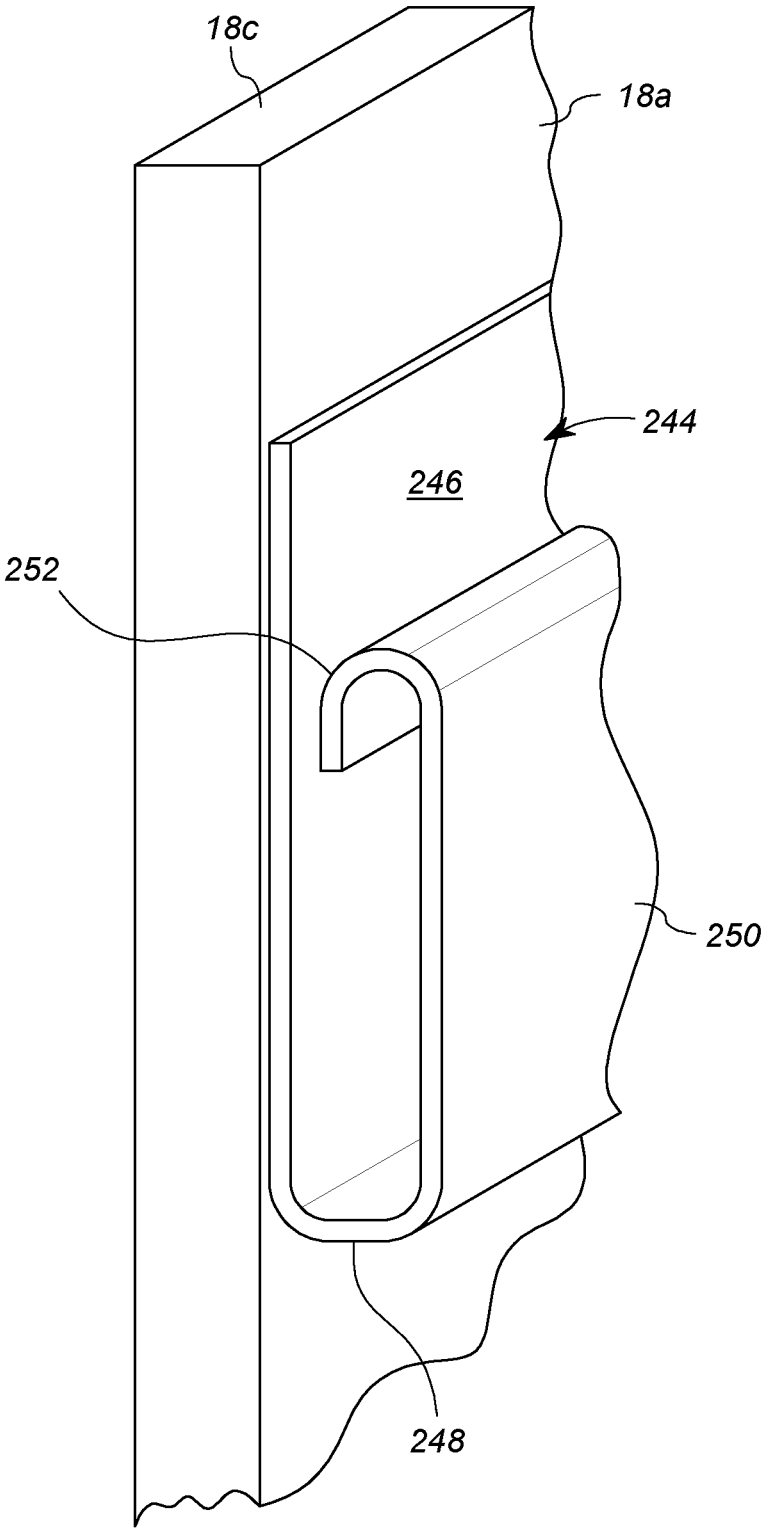
FIG. 9 shows another alternative embodiment of a receptacle that may be used in the casket of FIG. 2A to assist in mounting the cloth assembly.

FIG. 9 shows another alternative of a receptacle 244 that may be used in the container 12 of FIGS. 1 and 2. The receptacle 244 in this embodiment is an extruded piece of material, such as plastic or polymer, that forms a hooked top channel. The receptacle 244 includes a first plate or wall 246 attached to the side panel interior surface 18*a*, which extends at least half of the distance between the end panel 24 and the location on the side panel 18 where the cap 26 begins. The receptacle 244 also includes a second portion having a bottom wall 248 that extends inward from the first wall 246 and a retaining wall 250 that extends upward from the end of the bottom wall 248. At the top of the retaining wall 250 is a hooked portion 252 that hook inward (toward the first wall 246) and downward (toward the bottom wall 248). The bottom wall 248 is configured to engage the fold edge 34*c* of the substrate 34, and may suitably be substantially horizontal. The retaining wall 250 is configured to retain the substrate 34 laterally, in cooperation with the hooked portion 252. The hooked portion 252 provides a resilient spring bias and tight fit for holding the substrates 34 (and/or 134).

Figure 10:
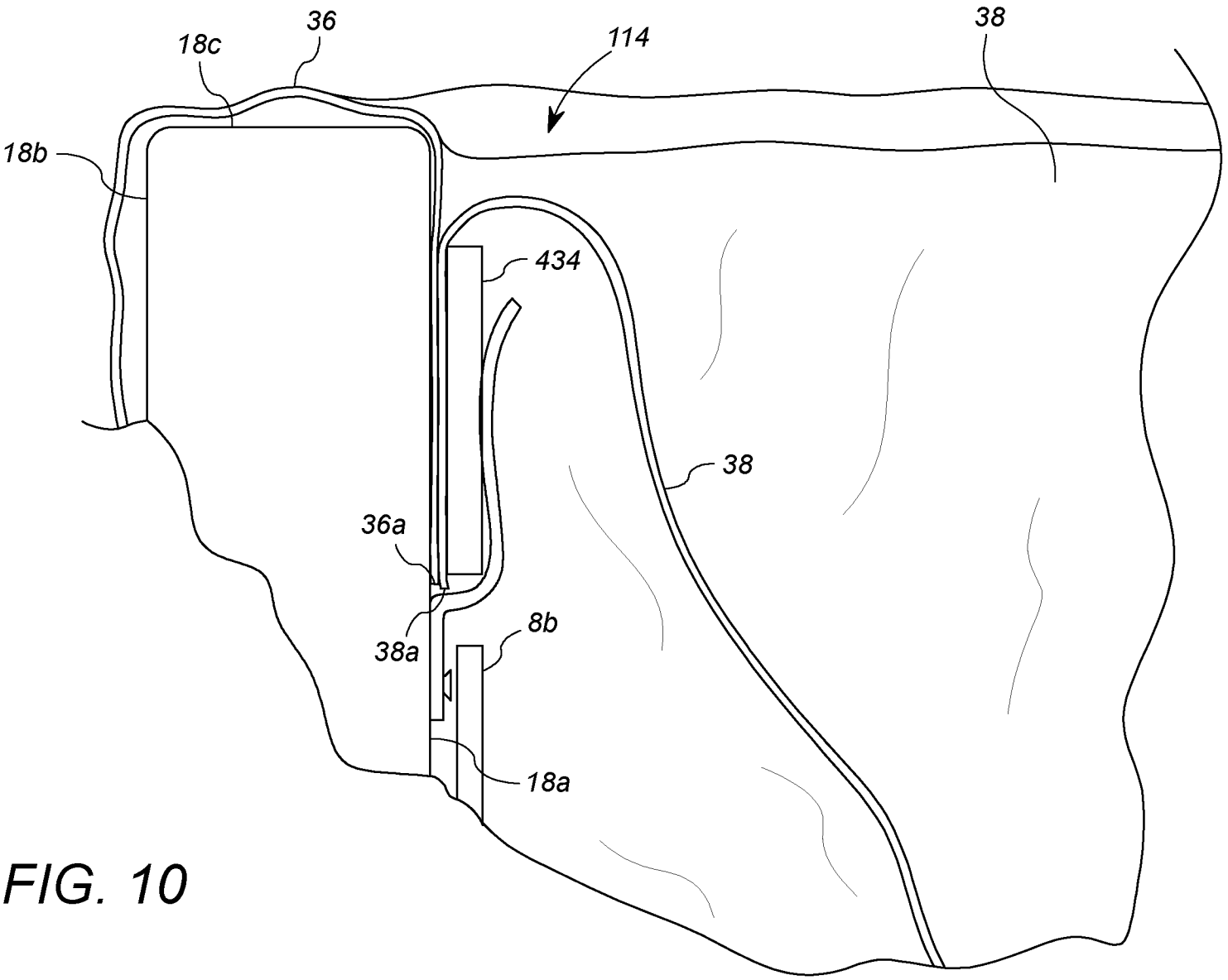
FIG. 10 shows a perspective view of an alternative embodiment of a cloth assembly that may be used in the funerary display arrangement of FIG. 1.

FIG. 10 shows a side cutaway view of an alternative embodiment of a cloth assembly 114 assembled into the container 12 of FIG. 1. In this embodiment, the substrate 434 is a plank of particle board or other rigid (typically wood-based) material that is not folded. The substrate 434 has a length substantially equal to that of the first portion 14*a* of the cloth assembly 14. The cloth assembly 114 thus is received in the receptacles 44 (or receptacle 144) on the side wall interior surface 18*a*, and another cloth assembly (of similar, but shorter, design) would be inserted into the receptacles 44 (or receptacle 144) on the end wall interior surface 24*a*.

Similar to the cloth assembly 14, the first lengthwise edge 36*a* of the first fabric segment 36 is secured to the substrate 434 along the length of the substrate 434 such that the second lengthwise edge 36*b* (see FIGS. 3 and 4) of the first fabric segment 36 can be disposed beyond at least one lengthwise edge of the substrate 434. Likewise, the first lengthwise edge 38*a* of the second fabric segment 38 is secured to the substrate 134 along the length of the substrate 134, such that the second lengthwise edge 38*b* of the second fabric segment 38 can be disposed beyond the at least one lengthwise edge of the substrate 38.

The first fabric segment 36 and the second fabric segment 38 may otherwise be deployed as, respectively, a casket skirt and a casket throw, in the same manner as discussed above in connection with FIGS. 1 to 7.

It will be appreciated that the novel cloth assemblies 14, 114, and other cloth assemblies having similar structures can also be used in connection with a single use-casket or cremation container or tray. For example, the cloth assembly 14 may be stapled directly to the wall of a wood, particle board, or paper-based casket container, and interred or cremated with the casket container. The cloth assemblies described herein provide a convenient method of improving the aesthetic appearance of the casket at the funereal display event even when a rental casket is not used.

It will be appreciated that the above-described embodiments are merely illustrative, and that those of ordinary skill in the art may readily devise their own implementations and modifications that incorporate the principles of the invention and fall within the spirit and scope thereof. For example, as discussed above, it will be appreciated that the display arrangements described herein may readily be expanded to cover additional exposed portions of the top edges of the casket container and/or casket insert.

What is claimed is:

1. A cloth assembly for a casket, comprising:

a first fabric segment having a first length and a first width;

a second fabric segment having a second length and a second width;

a substrate having a third length and a third width;

wherein:

at least a part of a first lengthwise edge of the first fabric segment is secured to the substrate along the third length of the substrate, such that a second lengthwise edge of the first fabric segment is disposed beyond at least one lengthwise edge of the substrate;

at least a part of first lengthwise edge of the second fabric segment is secured to the substrate along the third length of the substrate and adjacent to the first lengthwise edge of the first fabric segment, such that a second lengthwise edge of the second fabric segment is disposed beyond the at least one lengthwise edge of the substrate.

2. The cloth assembly of claim 1, wherein the substrate comprises a lengthwise folded cardboard substrate having a first portion folded over a second portion, and wherein at least a first part of the first lengthwise edge of the first fabric segment and at least a first part of the first lengthwise edge of the second fabric segment are disposed between the first portion and the second portion of the substrate.

3. The cloth assembly of claim 2, further comprising a second substrate having a first portion lengthwise folded over a second portion, and wherein a second part of the first lengthwise edge of the first fabric segment is disposed between the first portion of the second substrate and the second portion of the second substrate.

4. The cloth assembly of claim 3, wherein the substrate is sized and configured to fit adjacent to inside surface of a casket container, the casket container sized and configured to fit a deceased adult human body in the supine position.

5. The cloth assembly of claim 4, wherein the first width is sufficient to drape the first fabric segment over a top edge of the casket container and at least partially down an exterior surface of the casket container when the substrate is coupled adjacent to an inside surface of the casket container.

6. The cloth assembly of claim 5, wherein the second width exceeds the first width.

7. The cloth assembly of claim 1, further comprising a second substrate, wherein:

at least a second part of the first lengthwise edge of the first fabric segment is secured to the second substrate along a length of the second substrate;

at least a second part of the first lengthwise edge of the second fabric segment is secured to the second substrate along the length of the second substrate.

8. The cloth assembly of claim 1, further comprising a plurality of fasteners, each of the plurality of fasteners extending through the first portion of the substrate, the part of the first lengthwise edge of the first fabric segment, the part of the first lengthwise edge of the second fabric segment, and the second portion of the substrate.

9. The cloth assembly of claim 8, wherein each of the plurality of fasteners is a staple.

10. The cloth assembly of claim 1, wherein the substrate comprises an elongate chipboard plank, and wherein at least the part of the first lengthwise edge of the first fabric segment and at least the part of the first lengthwise edge of the second fabric segment are secured to a first side of the elongate chipboard blank.

11. The cloth assembly of claim 1, wherein the first fabric segment includes a crepe layer, a padding layer, and fabric layer.

12. The cloth assembly of claim 11, wherein the second fabric segment includes one or two layers of flexible sheet.

13. The cloth assembly of claim 1, wherein the part of a first lengthwise edge of the first fabric segment engages the substrate along the third length of the substrate, and engages the second fabric segment.

14. The cloth assembly of claim 1, wherein the substrate is more rigid than the first fabric segment and the second fabric segment.

15. The cloth assembly of claim 14, wherein the substrate is foldable.

16. The cloth assembly of claim 1, wherein the part of a first lengthwise edge of the first fabric segment is fastened to the substrate along the third length of the substrate.

17. A cloth assembly for a casket, comprising:

a first fabric segment having a first length and a first width;

a second fabric segment having a second length and a second width;

a substrate having a third length and a third width;

wherein:

at least a part of a first lengthwise edge of the first fabric segment is secured against the substrate along the third length of the substrate, such that a second lengthwise edge of the first fabric segment is disposed beyond at least one lengthwise edge of the substrate;

at least a part of first lengthwise edge of the second fabric segment is secured against the substrate along the third length of the substrate and adjacent to the first lengthwise edge of the first fabric segment, such that a second lengthwise edge of the second fabric segment disposed beyond the at least one lengthwise edge of the substrate.

18. The cloth assembly of claim 17, wherein the substrate comprises a lengthwise folded cardboard substrate having a first portion folded over a second portion, and wherein at least a first part of the first lengthwise edge of the first fabric segment and at least a first part of the first lengthwise edge of the second fabric segment are disposed between the first portion and the second portion of the substrate.

* * * * *